US008381650B2

(12) United States Patent
Glatthaar et al.

(10) Patent No.: US 8,381,650 B2
(45) Date of Patent: Feb. 26, 2013

(54) SAFETY AND ARMING UNIT FOR A FUSE

(75) Inventors: Karl Glatthaar, Oberndorf (DE); Reiner Hennig, Mönchweiler (GB); Gerhard Heussler, Zimmern-Stetten o.R. (DE); Karl Kautzsch, Schwanstetten (DE); Frank Martin Kienzler, Villingen-Schwenningen (DE); Alexander Zinell, Aichhalden (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 522 days.

(21) Appl. No.: 12/265,321

(22) Filed: Nov. 5, 2008

(65) Prior Publication Data

US 2009/0126593 A1 May 21, 2009

(30) Foreign Application Priority Data

Nov. 16, 2007 (DE) ..... 10 2007 054 777

(51) Int. Cl.
*F42C 15/34* (2006.01)

(52) U.S. Cl. ..... 102/222; 102/231; 102/235; 102/247; 102/254

(58) Field of Classification Search ..... 102/222, 102/247, 251, 262, 231, 235, 254
See application file for complete search history.

(56) References Cited

U.S. PATENT DOCUMENTS

| | | | | | |
|---|---|---|---|---|---|
| 2,516,323 | A * | 7/1950 | Jordan | 102/245 |
| 4,128,061 | A | 12/1978 | Kaiser | |
| 4,662,279 | A * | 5/1987 | Popovitch | 102/233 |
| 4,691,634 | A | 9/1987 | Titus et al. | |
| 4,744,298 | A * | 5/1988 | Popovitch | 102/235 |
| 4,770,096 | A * | 9/1988 | Maruska et al. | 102/229 |
| 4,938,138 | A * | 7/1990 | Maruska | 102/235 |
| 5,063,847 | A | 11/1991 | Halssig et al. | |
| 5,067,405 | A * | 11/1991 | Popovitch et al. | 102/232 |
| 5,271,327 | A * | 12/1993 | Filo et al. | 102/207 |
| 5,275,107 | A * | 1/1994 | Weber et al. | 102/251 |
| 5,693,906 | A | 12/1997 | Van Sloun | |
| 6,327,955 | B1 * | 12/2001 | Kerdraon et al. | 89/36.17 |
| 6,880,464 | B2 * | 4/2005 | Haeselich | 102/231 |

FOREIGN PATENT DOCUMENTS

| | | |
|---|---|---|
| DE | 26 43 828 A1 | 3/1978 |
| DE | 39 04 091 A1 | 8/1990 |
| DE | 39 35 180 C2 | 4/1991 |
| DE | 40 30 917 A1 | 4/1992 |
| DE | 696 11 922 T2 | 9/2001 |

* cited by examiner

*Primary Examiner* — James Bergin
(74) *Attorney, Agent, or Firm* — Laurence A. Greenberg; Werner H. Stemer; Ralph E. Locher

(57) ABSTRACT

A safety and arming unit for a fuse includes a firing chain having first and second firing devices defining an intermediate space therebetween and a barrier blocking the intermediate space in a safe position. The firing chain is brought into an armed position by a releasing movement vacating the intermediate space. First and second mutually independent securing devices lock the barrier in the safe position and execute an unlocking action based on two mutually independent physical arming parameters. A compact and very reliable safety and arming unit can be achieved in this way.

14 Claims, 5 Drawing Sheets

SAFETY AND ARMING UNIT FOR A FUSE

CROSS-REFERENCE TO THE RELATED APPLICATION

This application claims the priority, under 35 U.S.C. §119, of German Patent Application DE 10 2007 054 777.5, filed Nov. 16, 2007; the prior application is herewith incorporated by reference in its entirety.

BACKGROUND OF THE INVENTION

Field of the Invention

The invention relates to a safety and arming unit for a fuse, including a firing chain with a firing device and a barrier which is locked in its safe position by a first securing device and a second securing device that is independent of the first. The securing devices are configured to provide an unlocking action based on two physical arming parameters which are independent of one another.

A safety and arming unit for a fuse is used to prevent an inadvertent activation of a main charge of an explosive apparatus, in which activation of the main charge is, however, intended to be possible after arming. For that purpose, the safety and arming unit is a component of a fuse for firing the main charge provided with a firing chain including two or more firing devices. In order to fire the main charge, initially the first firing device, e.g. a puncture-sensitive mini-detonator which is punctured by mechanical measures for firing, is activated. Energy of the explosion of the first firing device is transferred to the second firing device, which can be constructed as a firing amplifier, by an appropriate configuration of the first two firing devices. The second firing device can transfer its explosion energy to an initial charge or a main charge.

In order to interrupt the firing chain, U.S. Pat. No. 4,691,634 discloses the provision of a barrier, through the use of which the second firing device is removed from the firing chain in the safe state in such a way that the explosion energy of the first firing device cannot reach it to the extent that it is able to fire. In order to arm the fuse, the barrier is moved, and with it the second firing device is moved into the firing chain, so that the first firing device can fire the second firing device.

SUMMARY OF THE INVENTION

It is accordingly an object of the invention to provide a safety and arming unit for a fuse, which overcomes the hereinafore-mentioned disadvantages of the heretofore-known devices of this general type and in which a small safety and arming unit is provided without loss of safety in order to be able to provide relatively small projectiles with safe fuses or in order to be able to house more components in large fuses.

With the foregoing and other objects in view there is provided, in accordance with the invention, a safety and arming unit for a fuse. The safety and arming unit comprises a firing chain having first and second firing devices defining an intermediate space therebetween and a barrier blocking the intermediate space in a safe position. The barrier is brought into an armed or setting position by a releasing movement vacating the intermediate space. First and second mutually independent securing devices lock the barrier in the safe position and execute an unlocking action based on two mutually independent physical arming parameters. The provision of the two independent securing devices ensures a high degree of safety. It is possible to block the intermediate space by using a compact component.

It is expedient that the arming parameters are physically independent from one another so that the unlocking action can be initiated by physically independent parameters, e.g. forces. These can be acceleration, spin, back pressure, time after launch, or impact pressure. Blocking can be achieved by the barrier being disposed in the intermediate space and at least partially filling the latter. The barrier vacates the intermediate space between the firing devices through the use of its releasing movement. In this context, the barrier can be removed from the intermediate space, or it can be changed in such a way that the intermediate space is vacated, e.g. the barrier in the intermediate space is pivoted from a horizontal to a vertical position. The vacated intermediate space does not have to be the entire intermediate space between the firing devices.

The firing device can be explosive charges, with the firing chain being able to include a further firing device in addition to the two firing devices, which is disposed in the firing chain in front of the two firing devices, or in particular behind the two firing devices. The barrier is used to remove and/or deflect ignition energy of the first firing device in such a way that firing of the second firing device by ignition energy of the first firing device is reliably prevented. The securing devices are used in particular to mechanically lock the barrier in such a way that a movement of the barrier from its safe position to the armed position is reliably prevented. Through the use of an unlocking action, the barrier can be released by the appropriate securing device in such a manner that it can be moved into the armed position, either of its own accord due to inertia, for example, or powered by movement devices.

In accordance with another feature of the invention, the firing devices remain at rest relative to one another during a releasing movement. There is no need to leave space to displace firing devices, as a result of which the safety and arming unit can be built compactly. The two firing devices expediently remain at rest during the releasing movement not only relative to one another, but also relative to a housing.

In accordance with a further feature of the invention, the first securing device is provided to directly mechanically change the arming parameter into the unlocking action. It can be unlocked independently of an electronic control and thus in an expedient and robust manner. Expediently, the first securing device is used to directly absorb energy of an arming parameter, in particular by its own inertia, and mechanically convert it into the unlocking action.

In accordance with an added feature of the invention, a high variability when initiating the unlocking action can be achieved by an electronic control unit for initiating the unlocking action of the second securing device. The initiation does not rely on the presence of forces but can be controlled freely, as a result of which high short-range safety is achievable. By way of example, activation of the firing chain can be limited to a predetermined period of time after launch so that it is not possible for a projectile to fire directly after leaving a launch tube. It is also possible for back pressure or oncoming flow to be integrated over time, as a result of which a flight route can be deduced, so that firing is only permitted after a certain distance from the launch tube.

In accordance with an additional feature of the invention, the unlocking action can be a movement of a micro-motor which drives the releasing movement of the barrier. However, it is particularly advantageous if the second securing device is provided to mechanically release the barrier so that it carries out the releasing movement through the use of the unlocking action. A motor can then be dispensed with and the safety and arming unit can be kept simple and compact. As a result of being released, the barrier can move of its own accord with the unlocking action and, by way of example, it can be pulled radially outwards due to centrifugal force or it can be moved when driven by an unlocking device, for example by a spring. The unlocking action and the releasing movement can be different processes, as a result of which a high degree of safety can be achieved.

In accordance with yet another feature of the invention, advantageously, the safety and arming unit includes an electronic control which has been prepared to control the unlocking action of at least one of the securing devices. The control in turn can be connected to a sensor to sense one of the arming parameters. If a predetermined value of the arming parameter is reached, e.g. a predetermined magnitude of a spin, the control unit can trigger the unlocking action.

In accordance with yet a further feature of the invention, advantageously, the electronic control is connected to two sensors for sensing two different arming parameters and controls the unlocking action of the second securing device on the basis of both arming parameters. The safety and arming unit can be used universally and can, for example, be programmed depending on use to process one or both arming parameters. By way of example, if the safety and arming unit is used in a projectile provided with spin, the control can be programmed to process the data of that sensor which senses spin. If the safety and arming unit is used in a projectile without spin, the control can be programmed to process data from another sensor, for example a back pressure sensor. It is likewise possible to process the data of both sensors and thus control the unlocking action in a more complex manner. The two arming parameters expediently differ from the arming parameter of the first securing device.

In accordance with yet an added feature of the invention, the second securing device includes a charging device to carry out the unlocking action through the use of a discharge. As a result of this, the second securing device can be compact. The charging device can be any device able to store a mechanical, chemical or electrical charge. In a simple variant, the charge is a spring which drives an unlocking action. The securing device can be particularly compact if the charge is a chemical charge, for example in the form of a pyrotechnic charge. As an alternative, or in addition, the charging device can be constructed to collect a charge, for example in the form of a pressure which can be formed by back pressure which pushes away a holding element, for example a bolt, and thus unlocks the barrier.

In accordance with yet an additional feature of the invention, the unlocking action can be particularly simple and the securing device can be particularly compact if the discharge is provided to separate and discard a holding element, provided to hold the barrier, from another element of the securing device. A bolt can thus be jettisoned, in particular blasted, as a result of which a previously fixed connection can be unfastened in a simple manner.

In accordance with again another feature of the invention, the first securing device has a double-bolt system. This simple system is particularly safe when acquiring longer acceleration as an arming parameter due to the two bolts which can only be activated in series.

If the radially outward releasing movement of the barrier occurs due to spin then the safety and arming unit can be particularly simple. If the safety and arming unit includes an unlocking device to move the barrier into the armed position, the safety and arming unit can also be used in projectiles without spin. A spring is a particularly simple unlocking device.

In order to have a high degree of safety from unintentional unlocking of the barrier, the unlocking device, that is to say for example the spring, should in principle not be in a state which permits movement of the barrier, but should only be able to move the barrier when an arming criterion is satisfied. One arming criterion is an unlocking action of one of the securing devices. If the first securing device is provided to charge the unlocking device by an unlocking action, safety can be achieved. The charging can be a tensioning, for example of a spring.

In accordance with again a further feature of the invention, a compact and robust charging of the unlocking device can be achieved if the first securing device has a face at an angle relative to an unlocking direction which, when it moves in the unlocking direction, produces the charge by movement of a charging device along the face. In a particularly simple embodiment which is unsusceptible to error, the face is guided along a spring arm, which is thus tensioned.

In accordance with again an added feature of the invention, the safety and arming unit can be made even more compact if the first firing device is particularly small, but nevertheless has sufficient power to fire the second firing device. This can be realized if the first firing device includes a projectile to fire the second firing device. Due to the kinetic energy of the projectile, the ignition energy of the first firing device is transferred to the second firing device which can be fired by a shock wave of the impacting projectile. The projectile can be a bolt or a cover of the first firing device which is blasted in the direction of the second firing device by a detonation of the first firing device.

The object of the barrier is to reliably interrupt the firing chain, even in the case of a misfire of the first firing device, so that the ignition energy of the first firing device does not reach the second firing device at all, if possible. In particular, when transferring ignition energy in the form of kinetic energy, the first firing device does not have to be completely shielded from the second firing device since no beam or jet of fire or back blast with unrestricted movement is transferring the ignition energy, and the barrier can be compact. However, particularly high requirements are placed on the barrier with regards to stability.

In accordance with a concomitant feature of the invention, these requirements can be satisfied if the barrier includes two different metals, as a result of which two different properties of metals can be used together, for example a high tensile strength combined with a very hard material. The shielding function of the barrier is particularly secure if it has a zone of harder metal between the firing devices and, outside of this zone, it has a further zone of softer metal. A TC-hard metal, with a proportion of tungsten carbide of over 90%, is particularly suitable as a harder metal. A hard metal with a hardness of over 90 according to Rockwell or over 1480 according to Vickers, in particular with a hardness of over 91.5 according to Rockwell or over 1700 according to Vickers, is likewise advantageous. However, the bending strength of such hard metals, possibly under 2000 $N/mm^2$, is not very high, and additionally they are quite costly and complex in processing into a form for the entire barrier. Therefore, it is proposed that the harder metal be embedded into the softer metal. This can be distinguished by a lower hardness than the harder metal, as well as in particular by easier machinability for simpler processing.

Other features which are considered as characteristic for the invention are set forth in the appended claims.

Although the invention is illustrated and described herein as embodied in a safety and arming unit for a fuse, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
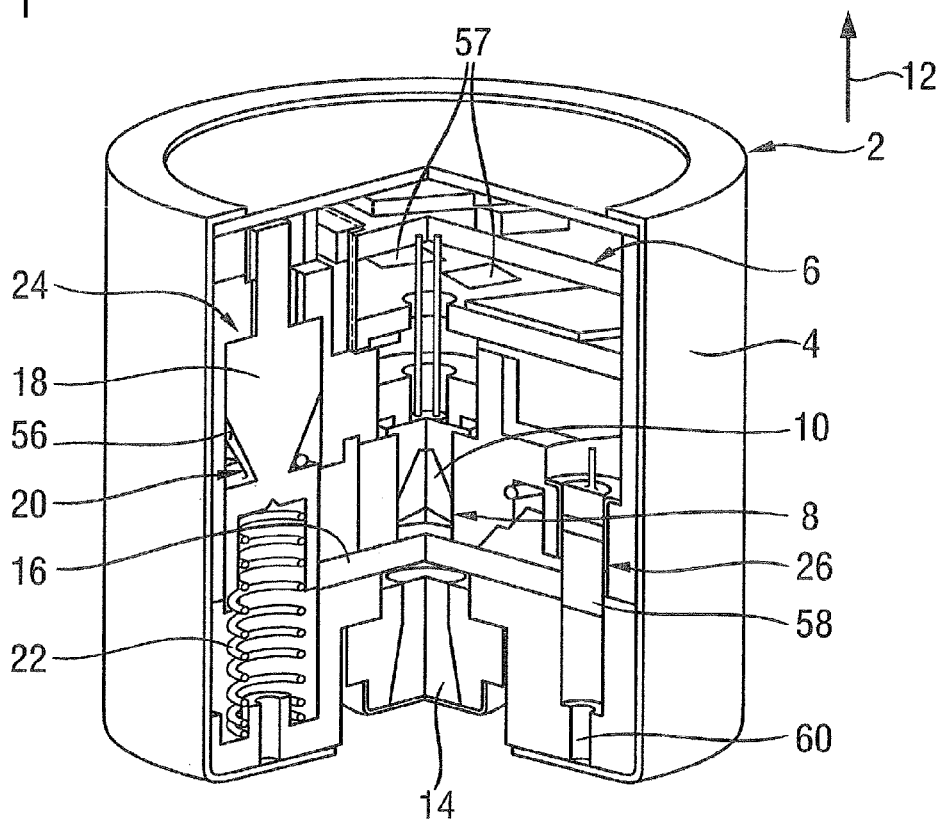
FIG. 1 is a diagrammatic, sectional, perspective view of a safety and arming unit.

Referring now to the figures of the drawings in detail and first, particularly, to FIG. 1 thereof, there is seen a safety and arming unit 2 for a fuse including, in its upper part, a housing 4 with an electronic control unit 6 and a firing chain 8 therebelow including first and second firing devices 10, 14. The firing chain 8 includes a detonator acting as the first firing device 10 on a center axis of the fuse. The center axis is intended to be seen relative to a rotation about a direction of flight 12. A firing amplifier, acting as the second firing device 14, disposed below the first firing device 10 and likewise on the center axis, is aligned on an underside of the detonator lying above in order to receive ignition energy therefrom. A barrier 16 is located between the two firing devices 10, 14 and, in its position shown in FIG. 1, blocks a passage between the firing devices 10, 14. A bolt 18 of a double-bolt system 20 is illustrated in section to the left of the barrier 16 in FIG. 1 and is pushed in the direction of flight 12 by a spring 22. The double-bolt system 20 is a part of a first securing device 24 for locking the barrier 16 in its safe position. A second securing device 26, constructed as a force element, is illustrated to the right of the barrier 16.

The barrier 16 is illustrated from below in FIG. 2, with the words "upwards" being intended to mean in the direction of flight 12 and "downwards" against the direction of flight 12. The spring 22 of the second bolt 18 and a spring 28 of a further bolt 30 of the double-bolt system 20 can be seen, as well as a locking spring 32 to clamp down the bolt 18 in the unlocked state. The locking spring 32 is inactive in the locking position of the bolt 18 illustrated in FIG. 2. Furthermore, an additional locking spring 34, which is also inactive in FIG. 2, can be seen and is used to hold the barrier 16 in an unlocked state (compare FIG. 7).

Figure 3:
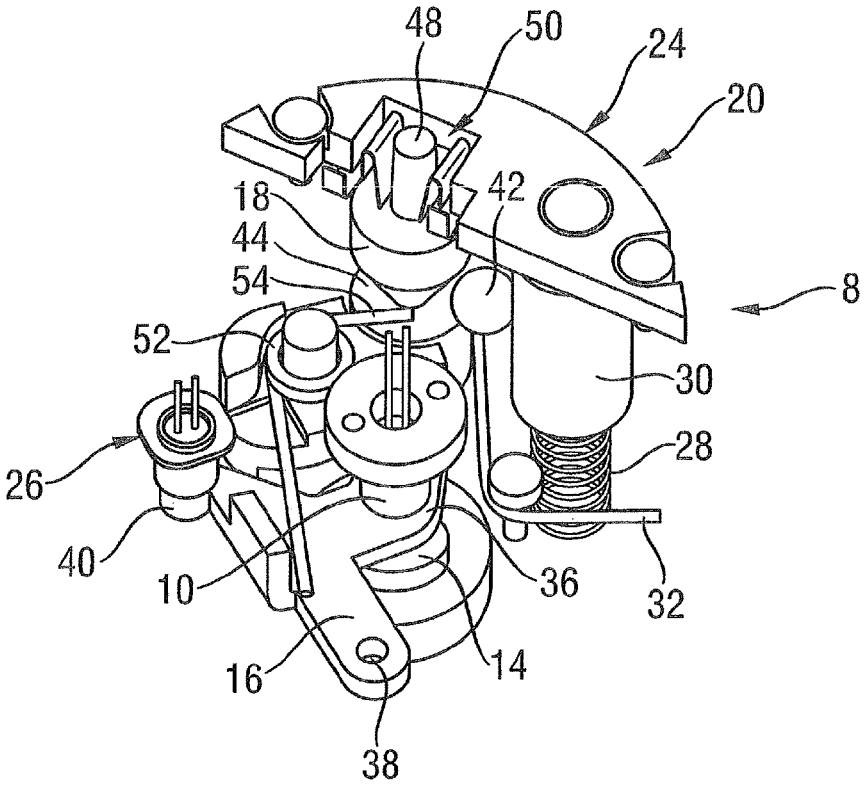
FIG. 3 is a fragmentary, perspective view of a firing chain of the safety and arming unit according to FIG. 1.

FIG. 3 shows the firing chain 8 in its safe position. A zone 36 of the barrier blocks an intermediate space between the two firing devices 10, 14 by filling out the intermediate space. The blockage is achieved by blocking a passage between the end of the first firing device 10 facing the second firing device 14 and the end of the second firing device 14 facing the first firing device 10, so that each direct line between the ends runs through the barrier 16.

Figure 2:
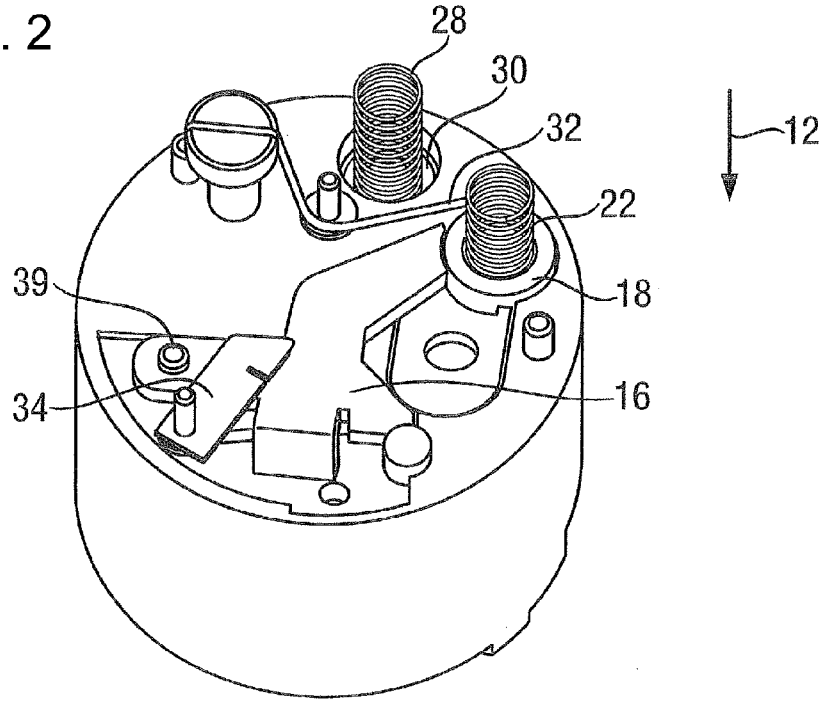
FIG. 2 is a bottom-perspective view of a portion of the safety and arming unit according to FIG. 1.

The barrier 16 is held at a point of rotation 38 by a bolt 39 illustrated in FIG. 2 and a holding element 40 of the force element 26 prevents it from being able to pivot radially outwards in a releasing motion. As can be seen in FIG. 2, the barrier 16 also abuts against the second bolt 18, which prevents the barrier from being able to rotate in the releasing movement in a clockwise direction in FIG. 2.

The firing chain 8 is interrupted by the barrier 16 in the safe position. The barrier 16 is locked on one hand directly by the force element 26 and on the other hand by the second bolt 18 and thus conforms to the directive STANAG 4187 (NATO Standardization Agreements for procedures and systems and equipment components). The second bolt 18 is in turn locked by the first bolt 30, since a ball 42 between the bolts 18, 30 prevents translational movement of the second bolt 18. The ball 42 is disposed in a groove 44 of the second bolt 18 and would have to be pushed downwards out of the groove 44 in the case of movement of the second bolt 18. This is prevented by the first bolt 30, which blocks the outward movement of the ball 42 out of the groove 44.

Figure 4:
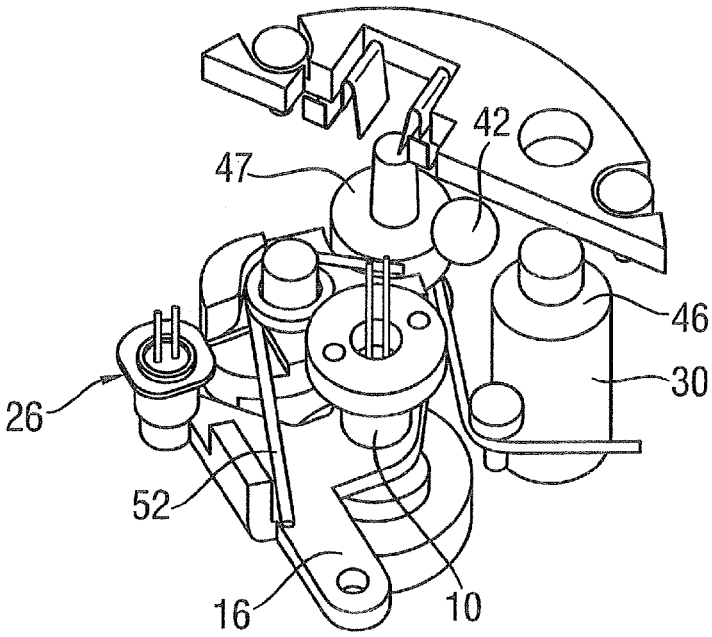
FIG. 4 is a fragmentary, perspective view showing the firing chain after a first unlocking action.

The arming process of the safety and arming unit 2 is described in the following on the basis of FIGS. 4 to 7. The arming process is initiated directly after the launch of the projectile which incorporates the safety and arming unit 2. As a result of the large acceleration of the safety and arming unit 2 in the direction of flight 12 during the launch, the two bolts 18, 30 are pushed backwards relative to the barrier 16, for example, and pushed against the resilient forces of the springs 22, 28 due to their inertia. However, a movement of the second bolt 18 is initially blocked by the ball 42. However, the first bolt 30 is uninhibited in its downward movement and is pushed into the position shown in FIG. 4. Now the ball 42 is pushed out of the groove 44 and into a taper 46 of the first bolt 30 by the inertial force of the second bolt 18, so that the ball 42 releases a downward movement of the second bolt 18, as is illustrated in FIG. 4.

A number of further arming processes are caused by the downward arming movement of the second bolt 18. First of all, the locking spring 32 latches into an undercut 47 in the second bolt 18 and thus blocks a backward movement of the second bolt 18 into the locked position. In addition, a contact element 48 in the form of a pin is moved out of a contact unit 50, so that an electrical contact in the contact unit 50 is interrupted. This is registered by the control unit 6 and is used to control at least one further unlocking action. Furthermore, an unlocking device 52 constructed as a spring is loaded to move the barrier 16 into its armed position by tensioning the spring. In order to do this, an arm of the spring, referred to in the following as a charging device 54, is guided along an angled face 56 of the second bolt 18 and is tensioned, and hence charged, by moving the angled face 56 downwards, that is to say in the unlocking direction of the second bolt 18. The charged unlocking device 52 now exerts a pressure on the barrier 16 into its armed position. However, this pressure is balanced by the second securing device 26 which is still locked, so that the barrier 16 does not yet move due to the pressure.

Opening the contact unit 50 initiates the operation of an unlocking program in the control unit 6. The unlocking program can, for example, query data of a sensor 57 sensitive to a predetermined unlocking parameter, for example back pressure or centrifugal force and hence spin, or it can be sensitive to pressure generated by impact. The centrifugal force can be measured in or on the safety and arming unit 2 by an element being pushed outwards against a resilient or elastic force and hence against a contact, with the element closing this contact. Other electrically queried sensors 57 connected to the control unit 6 are also feasible.

If the unlocking parameter deposited in the control unit 6 or selected by the control unit 6 reaches a predetermined value or a value determined by the control unit 6, a further unlocking action is controlled by the control unit 6. It is also feasible for the unlocking action to be controlled by a timer and without a sensor.

Figure 5:
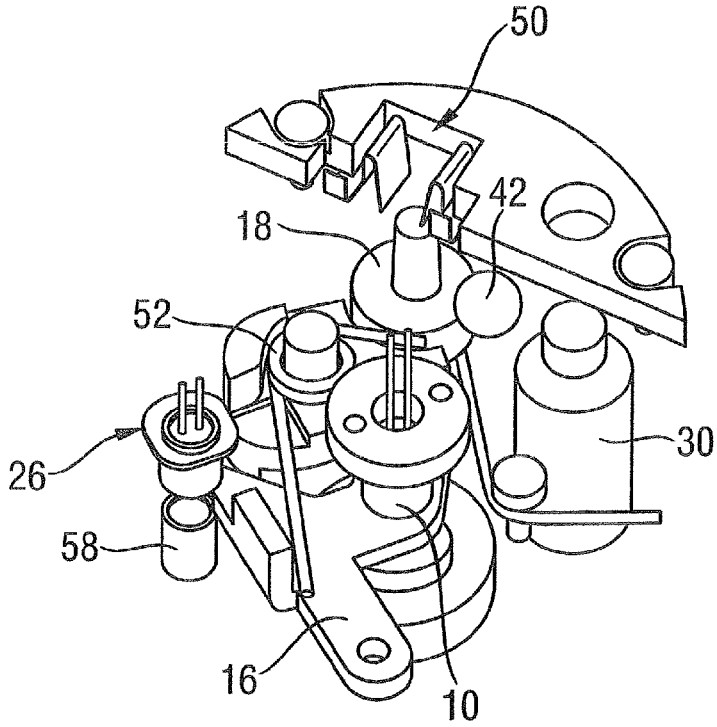
FIG. 5 is a fragmentary, perspective view showing the firing chain after a further unlocking action.

The unlocking action in the exemplary embodiment shown in FIG. 5 is carried out by the second securing device 26. The securing device 26 is actuated by the control unit 6 and includes a charging device with a pyrotechnic charge which is now fired electrically. Through the use of this action, a holding element 58, in the form of a bolt and provided to hold the barrier 16, is blasted from the rest of the securing device 26. In order to improve the release of the holding element 58 from the remainder of the securing device 26, an exhaust opening 60 is located in the safety and arming unit 2 for the fuse (see FIG. 1), through which air displaced by the holding element and the explosive gasses of the explosive charge where appropriate can escape. Alternatively, the charging device can have a charge in the form of a tensioned spring, which is relaxed during the unlocking action. Different forms of stored energy are also feasible.

Figure 6:
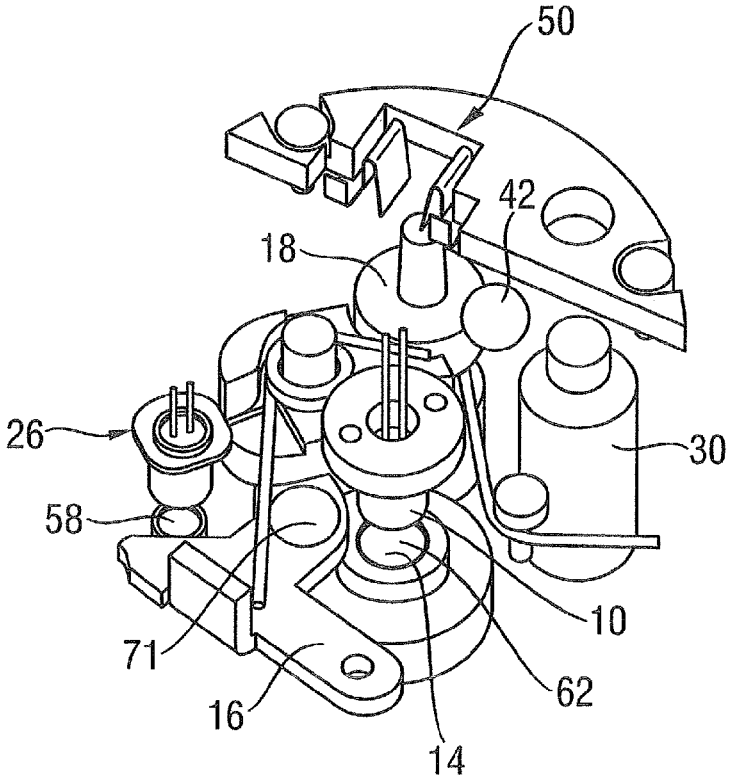
FIG. 6 is a fragmentary, perspective view showing the firing chain with a barrier after a releasing movement.

After the holding element 58 has been blasted off, the barrier 16 can carry out its releasing movement and assume its armed position, as shown in FIG. 6. The releasing movement in this case can be effected by the unlocking device 52 which pushes the barrier outwards, or by centrifugal forces caused by the spin which are only assisted by the unlocking device 52. A stop terminates the releasing movement.

Figure 7:
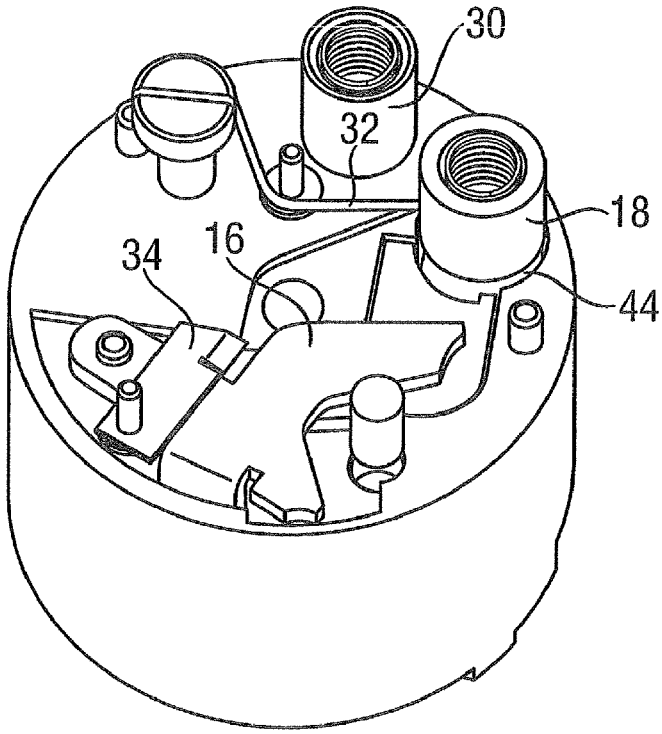
FIG. 7 is a bottom-perspective view showing the barrier locked by a spring.

The barrier 16 is held in its armed position by the spring 34 illustrated in FIG. 7. It latches in behind the barrier and holds it securely, so that the status of the armed position is maintained.

The barrier 16 is removed from an intermediate space 62 between the firing devices 10, 14 by the releasing movement, so that the intermediate space 62 is vacated. Now explosion energy can be transferred from the first firing device 10 to the second firing device 14. Firing of the first firing device 10 is controlled by the control unit 6 according to parameters which can be programmed and values of the parameters, for example according to time, flight route or impact.

Figure 8:
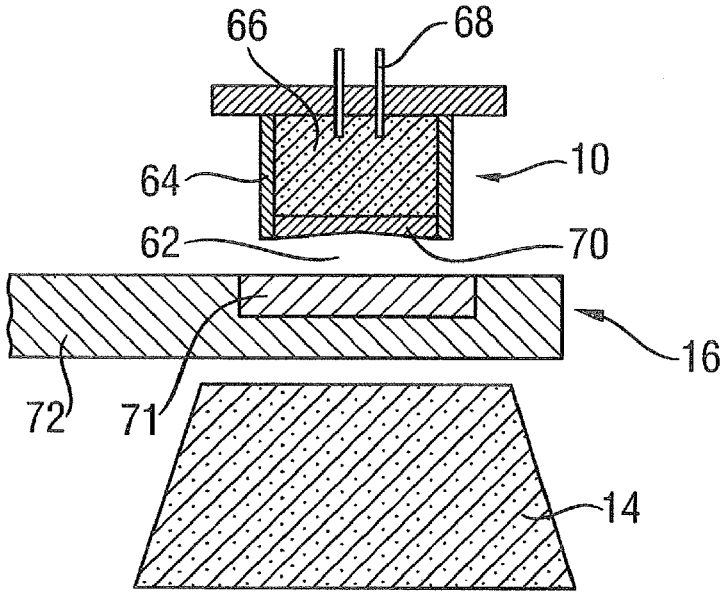
FIG. 8 is a longitudinal-sectional view through two firing devices and the barrier disposed between the two.

FIG. 8 shows the two firing devices 10, 14 and the barrier 16 in the intermediate space 62 in a fragmentary, sectional view. The first firing device 10 includes a housing 64 containing one or more pyrotechnic charges 66 which can be fired electrically by firing contacts 68 actuated by the control unit 6. In the case of a detonation, a projectile 70, for example in the form of a cover, is blasted downwards with a very high velocity. If the barrier 16 is removed from the intermediate space 62, the projectile 70 impacts on the second firing device 14 and transfers ignition energy in the form of kinetic energy to the second firing device 14, through which the latter is fired.

In the case of a malfunction of the safety and arming unit, in particular in the case of a faulty detonation of the first firing device 10, it is the function of the barrier 16 to prevent this transfer of ignition energy. For this purpose, it includes a zone 71 of a hard metal, for example a hard metal of the materials group K10 of ISO standard 513, which is matched to the first firing device 10 in such a way that it is hard enough to intercept the projectile 70. In order to prevent the barrier 16 from breaking, the zone 71 is adjacent a further zone 72 which includes a softer and deformable metal. In particular, the hard metal is embedded into the softer metal in the zone 72.

Figure 9:
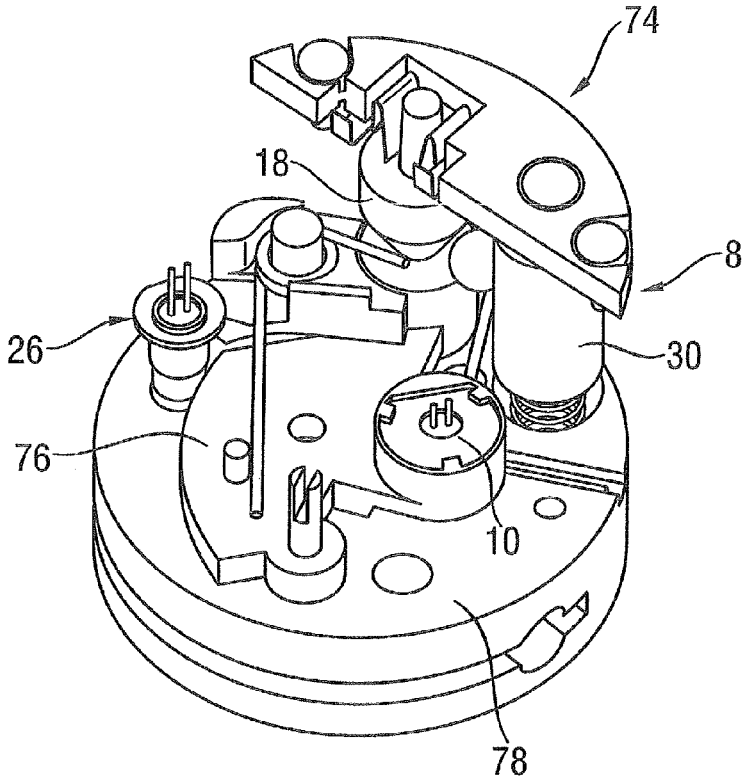
FIG. 9 is a fragmentary, perspective view showing an alternative firing chain with a displaceable firing device.
Figure 10:
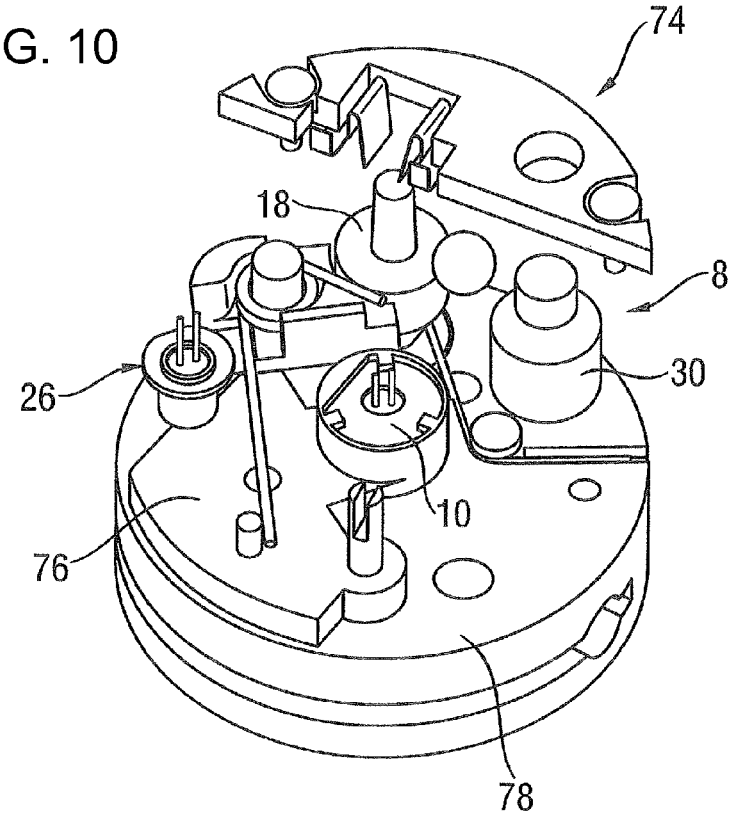
FIG. 10 is a fragmentary, perspective view showing the firing chain according to FIG. 9 with a barrier in the armed position.

FIGS. 9 and 10 show a further exemplary embodiment of a safety and arming unit 74 for a fuse. The following description is substantially limited to the differences from the exemplary embodiment of the preceding figures, to which reference is made with regard to features and functions that remain identical. Components which substantially remain the same are referred to by the same reference symbols as a matter of principle.

FIG. 9 illustrates the safety and arming unit 74 in its safe position and FIG. 10 illustrates it in its armed position. The safety and arming unit 74 houses a barrier 76 having a releasing movement which is carried out as described above, but which carries the first firing device 10 in contrast to the barrier 16. In the safe position of the barrier 76, the first firing device 10 is disposed outside of the center axis, so that an erroneous detonation guides the ignition energy to a holding plate 78 and it does not reach the second firing device 14. In addition, the barrier 76 blocks an intermediate space between the firing devices 10, 14 by filling it, at least in part. It is only once it is in the armed position, that the first firing device 10 is disposed on the center axis and thus directly above the second firing device 14 and aligned with respect thereto in such a way that the ignition energy can be transferred and the firing chain 8 is not interrupted.

The invention claimed is:

1. A safety and arming unit for a fuse, the safety and arming unit comprising:

a firing chain having first and second firing devices defining an intermediate space therebetween and a barrier blocking said intermediate space in a safe position, said barrier being brought into an armed position by a releasing movement vacating said intermediate space;

first and second mutually independent securing devices locking said barrier in said safe position and executing an unlocking action based on two mutually independent physical arming parameters; and an unlocking device for moving said barrier into said armed position.

2. The safety and arming unit according to claim 1, wherein said firing devices remain at rest relative to one another during said releasing movement.

3. The safety and arming unit according to claim 1, wherein said first securing device is configured to directly mechanically change said arming parameter into said unlocking action.

4. The safety and arming unit according to claim 1, which further comprises an electronic control unit for initiating said unlocking action of said second securing device.

5. The safety and arming unit according to claim 1, wherein said second securing device is configured to mechanically release said barrier for carrying out said releasing movement by said unlocking action.

6. The safety and arming unit according to claim 1, wherein said first securing device has a double-bolt system.

7. The safety and arming unit according to claim 1, wherein said barrier experiences a radially outward releasing movement due to spin.

8. The safety and arming unit according to claim 1, wherein said first securing device is configured to charge said unlocking device by an unlocking action.

9. The safety and arming unit according to claim 8, wherein said first securing device has a face disposed at an angle relative to an unlocking direction, said face, upon moving in an unlocking direction, producing a charge by movement of a charging device along said face.

10. The safety and arming unit according to claim 1, wherein said first firing device includes a projectile for firing said second firing device.

11. A safety and arming unit for a fuse, the safety and arming unit comprising:

a firing chain having first and second firing devices defining an intermediate space there between and a barrier blocking said intermediate space in a safe position, said barrier being brought into an armed position by a releasing movement vacating said intermediate space;

first and second mutually independent securing devices locking said barrier in said safe position and executing an unlocking action based on two mutually independent physical arming parameters; and an electronic control unit and two sensors connected to said electronic control unit for sensing two different arming parameters and controlling said unlocking action of said second securing device on a basis of said two arming parameters.

12. A safety and arming unit for a fuse, the safety and arming unit comprising:

a firing chain having first and second firing devices defining an intermediate space there between and a barrier blocking said intermediate space in a safe position, said barrier being brought into an armed position by a releasing movement vacating said intermediate space;

first and second mutually independent securing devices locking said barrier in said safe position and executing an unlocking action based on two mutually independent physical arming parameters;

said second securing device including a charging device for carrying out said unlocking action by a discharge;

a holding element configured to hold said barrier; and another element of said securing device;

said discharge separating and discarding said holding element from said other element of said securing device.

13. The safety and arming unit according to claim 12, wherein said charging device has a pyrotechnic charge.

14. A safety and arming unit for a fuse, the safety and arming unit comprising:

a firing chain having first and second firing devices defining an intermediate space there between and a barrier blocking said intermediate space in a safe position, said barrier being brought into an armed position by a releasing movement vacating said intermediate space: and first and second mutually independent securing devices locking said barrier in said safe position and executing an unlocking action based on two mutually independent physical arming parameters:

said barrier having one zone of relatively harder metal between said firing devices and a further zone of relatively softer metal outside of said one zone.

* * * * *